US005865190A

United States Patent [19]

Butler

[11] Patent Number: 5,865,190

[45] Date of Patent: Feb. 2, 1999

[54] HAIR GROUPING AND SEPARATING CLIP APPARATUS AND METHOD FOR USE IN COLORING ALTERNATING HAIR BUNDLES

[76] Inventor: Ronald E. Butler, 3998 Roan La. W., Lake Park, Fla. 33403

[21] Appl. No.: 934,578

[22] Filed: Sep. 22, 1997

[51] Int. Cl.[6] ..... A61K 7/13

[52] U.S. Cl. ..... 132/208; 132/277; 132/270

[58] Field of Search ..... 132/208, 125, 132/126, 161, 276, 277, 270, 207, 144, 145, 146, 152, 213, 213.1, 214, 135

[56] References Cited

U.S. PATENT DOCUMENTS

| | | | |
|---|---|---|---|
| D. 298,866 | 12/1988 | Reed . | |
| 952,491 | 3/1910 | Youngs | 132/161 |
| 1,040,711 | 10/1912 | Longden | 132/214 |
| 1,286,823 | 12/1918 | Stahle | 132/213.1 |
| 1,853,828 | 4/1932 | Mani | 132/214 |
| 3,960,158 | 6/1976 | Simmons . | |
| 4,049,006 | 9/1977 | Saunders et al. . | |
| 4,414,992 | 11/1983 | Russell | 132/135 |
| 4,993,438 | 2/1991 | Hunt . | |
| 5,365,952 | 11/1994 | Noble et al. | 132/144 |
| 5,494,060 | 2/1996 | Potut . | |
| 5,549,127 | 8/1996 | Chang | 132/276 |
| 5,642,740 | 7/1997 | Chen | 132/277 |
| 5,704,376 | 1/1998 | Ogunro | 132/161 |

*Primary Examiner*—Todd E. Manahan
*Assistant Examiner*—Eduardo C. Robert
*Attorney, Agent, or Firm*—Oltman, Flynn & Kubler

[57] ABSTRACT

A clip apparatus for grouping and separating a series of bundles of hair on the scalp of a person, for applying coloring matter to alternating bundles of hair, includes a clip having a clip upper jaw having a forward jaw edge and a rearward jaw edge with a series of notches along the forward jaw edge defining a series of laterally spaced apart hair holding panels for holding bundles of hair against the user scalp, and a clip lower jaw having a forward jaw edge and a rearward jaw edge and having an upwardly projecting comb with comb teeth spaced apart from each other and having tooth free ends configured to engage and support bundles of hair, the comb teeth being positioned so that they swing between adjacent pairs of holding panels when the clip is closed; and a hinge structure interconnecting the clip upper jaw and the clip lower jaw at the rearward jaw edges. A method of coloring alternating bundles of hair includes the steps of lifting away from the scalp a top layer of hair; pivoting the clip upper jaw relative to the clip lower jaw to open the clip; sliding the layer of hair laterally into the clip between the clip upper jaw and the clip lower jaw; pivoting the clip upper jaw relative to the clip lower jaw to close the clip, so that the comb teeth free ends engage and move bundles of hair from the layer between the holding panels.

3 Claims, 3 Drawing Sheets

HAIR GROUPING AND SEPARATING CLIP APPARATUS AND METHOD FOR USE IN COLORING ALTERNATING HAIR BUNDLES

BACKGROUND OF THE INVENTION

1. Field of the Invention

The present invention relates generally to the field of hair care and coloring. More specifically the present invention relates to a clip apparatus for evenly grouping and separating a series of bundles of hair, and lifting every other bundle away from the scalp so that the lifted bundles can be bleached or colored to contrast with the remaining bundles and produce a streaking effect. The apparatus includes a clip having a clip upper jaw and a clip lower jaw interconnected along rearward jaw edges by a hinge structure, the clip upper and lower jaws being biased with a hinge spring to close together. Upper and lower finger tabs protrude rearwardly from the clip upper jaw and clip lower jaw rearward jaw edges, respectively, at one side of the clip. The finger tabs are oriented to be spaced apart from each other when the clip is closed, so that the user can open the clip by pressing the finger tabs toward each other. The upper jaw has a series of notches along its forward edge defining a series of laterally spaced apart hair holding panels for holding alternating bundles of hair against the scalp. The lower jaw has an upwardly projecting comb with broad teeth spaced apart from each other and positioned such that they swing between adjacent pairs of holding panels when the clip is closed. Each comb tooth free end has an upwardly opening concave recess to engage and move a bundle of hair between adjacent holding panels and above the upper jaw.

2. Description of the Prior Art

Hair streaking is commonly performed entirely by hand. The hair dresser uses the handle of a rat-tail comb, for example, to dip into a layer of hair, lift a hair bundle away from the scalp, then skip a bundle and dip into the layer again and lift away another hair bundle, until a series of spaced apart bundles of hair rest on the comb handle. Then the hair dresser places a sheet of aluminum foil between the series of lifted hair bundles and the alternating bundles not lifted. Either bleach or hair coloring matter is applied to the lifted hair bundles and permitted to take effect. This is a laborious and time consuming process, inconveniencing the customer and reducing the efficiency of the hair dresser.

Various devices have been developed for manipulating hair for applying coloring matter, for weaving hair and for other purposes. One such device is that of Hunt, U.S. Pat. No. 4,993,438, issued on Feb. 19, 1991, for a hair weaving comb and method of use. Hunt includes a set of legs extending laterally from an elongate support member. The distal ends of the legs include hair engaging teeth for separating a section of hair into sub-sections. Inserting the comb into a layer of hair gathers subsections of the hair on the leg distal ends and permits alternating subsections of hair to drop between the legs and thereby separate. A problem with Hunt is that the hair dresser is still left with the task of picking up and holding onto the several alternating subsections between the comb legs and swinging them outward. Another problem is that the hair dresser must find a way to prop the lifted sub-sections of hair while applying coloring matter to them.

Potut, U.S. Pat. No. 5,494,060, issued on Feb. 27, 1996, discloses a hair clip with annular springs. The Potut clip is intended to be worn as ornamentation and probably for holding part of a hair style in place. Although Potut may serve these specific purposes, it is not suited to nor capable of separating and holding apart bundles of hair for coloring or bleaching alternate bundles. The outwardly curved ends of the legs extending from the two meshing Potut jaws are incapable of engaging hair bundles. The curved shape of the legs themselves also makes Potut poorly suited to a hair bundle separating function.

The prior art also reveals several hair devices which are suitable for weaving hair but generally not suitable for streaking it. These devices also tend to be bulky and expensive to manufacture. They include Saunders, et al., U.S. Pat. No. 4,049,006, issued on Sep. 20, 1977 for a hair weaving device; Simmons, U.S. Pat. No. 3,960,158, issued on Jun. 1, 1976 for a hair weaving tension system; and Reed, U.S. Pat. No. Des. 298,866, issued Dec. 6, 1988 for a hair weaving machine.

It is thus an object of the present invention to provide a hair streaking clip apparatus which receives a layer of hair and divides the layer into equally sized bundles of hair and separates alternating bundles for coloring automatically.

It is another object of the present invention to provide such an apparatus which provides a supporting surface for separated hair bundles while they are being colored or bleached.

It is still another object of the present invention to provide such an apparatus which is fast, reliable and does not pull hair or otherwise cause the person on which it is used any discomfort.

It is finally an object of the present invention to provide such an apparatus which is compact, reliable and very economical to manufacture.

SUMMARY OF THE INVENTION

The present invention accomplishes the above-stated objectives, as well as others, as may be determined by a fair reading and interpretation of the entire specification.

A clip apparatus is provided for grouping and separating a series of bundles of hair on the scalp of a person, for applying coloring matter to alternating bundles of hair, including a mechanism for grouping and separating a series of bundles of hair; and a mechanism for automatically lifting every other bundle of hair away from the scalp for selective application of coloring matter to the lifted bundles.

A clip apparatus is also provided for grouping and separating a series of bundles of hair on the scalp of a person, for applying coloring matter to alternating bundles of hair, including a clip having a clip upper jaw having a forward jaw edge and a rearward jaw edge with a series of notches along the forward jaw edge defining a series of laterally spaced apart hair holding panels for holding bundles of hair against the user scalp, and a clip lower jaw having a forward jaw edge and a rearward jaw edge and having an upwardly projecting comb with comb teeth spaced apart from each other and having tooth free ends configured to engage and support bundles of hair, the comb teeth being positioned so that they swing between adjacent pairs of holding panels when the clip is closed; and a hinge structure interconnecting the clip upper jaw and the clip lower jaw at the rearward jaw edges.

The clip apparatus preferably additionally includes an upper finger tab protruding generally rearwardly from the clip upper jaw; a lower finger tab protruding generally rearwardly from the clip lower jaw; the finger tabs being configured and oriented relative to the clip upper jaw and the clip lower jaw to be spaced apart from each other when the clip upper and lower jaws are closed together, so that pressing the finger tabs toward each other separates the upper and lower jaws to open the clip. The clip apparatus preferably still additionally includes a spring biasing mechanism biasing the clip upper jaw and the clip lower jaw toward each other so that the clip closes automatically.

A recess is preferably provided in each comb tooth free end for engaging and moving a bundle of hair between adjacent holding panels. The comb is optionally removably attached to the clip lower jaw with a comb connection mechanism. The clip upper jaw is optionally divided into a forward portion including the panels and the notches and a rearward portion, the forward portion being removably attached to the rearward portion with an upper jaw portion interconnection mechanism. The clip apparatus preferably additionally includes a hair bundle support platform connected to and extending over the upper jaw. The clip apparatus preferably additionally includes a clip support flange extending generally downwardly from the lower jaw for propping the clip against the scalp while the clip engages a layer of hair.

A method of coloring alternating bundles of hair using the above-described apparatus is provided, including the steps of lifting away from the scalp a top layer of hair; pivoting the clip upper jaw relative to the clip lower jaw to open the clip; sliding the layer of hair laterally into the clip between the clip upper jaw and the clip lower jaw; pivoting the clip upper jaw relative to the clip lower jaw to close the clip, so that the comb teeth free ends engage and move bundles of hair from the layer between the holding panels, thereby elevating alternating bundles of hair, and so that each holding panel holds adjacent bundles of hair against the scalp; pulling the free ends of the elevated bundles of hair out from underneath the clip upper jaw and laying the elevated bundles of hair over the clip upper jaw; applying hair coloring matter to the elevated bundles of hair and permitting the coloring matter to color the elevated bundles; pivoting the clip upper jaw relative to the clip lower jaw to open the clip; and sliding the layer of hair out of the clip.

Wherein the clip apparatus further includes a platform secured onto the upper surface of the clip upper jaw, the method preferably includes the additional step of placing the elevated bundles of hair onto the platform. The method preferably additionally includes the step of placing a sheet of aluminum foil between the elevated bundles of hair and the clip upper jaw.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
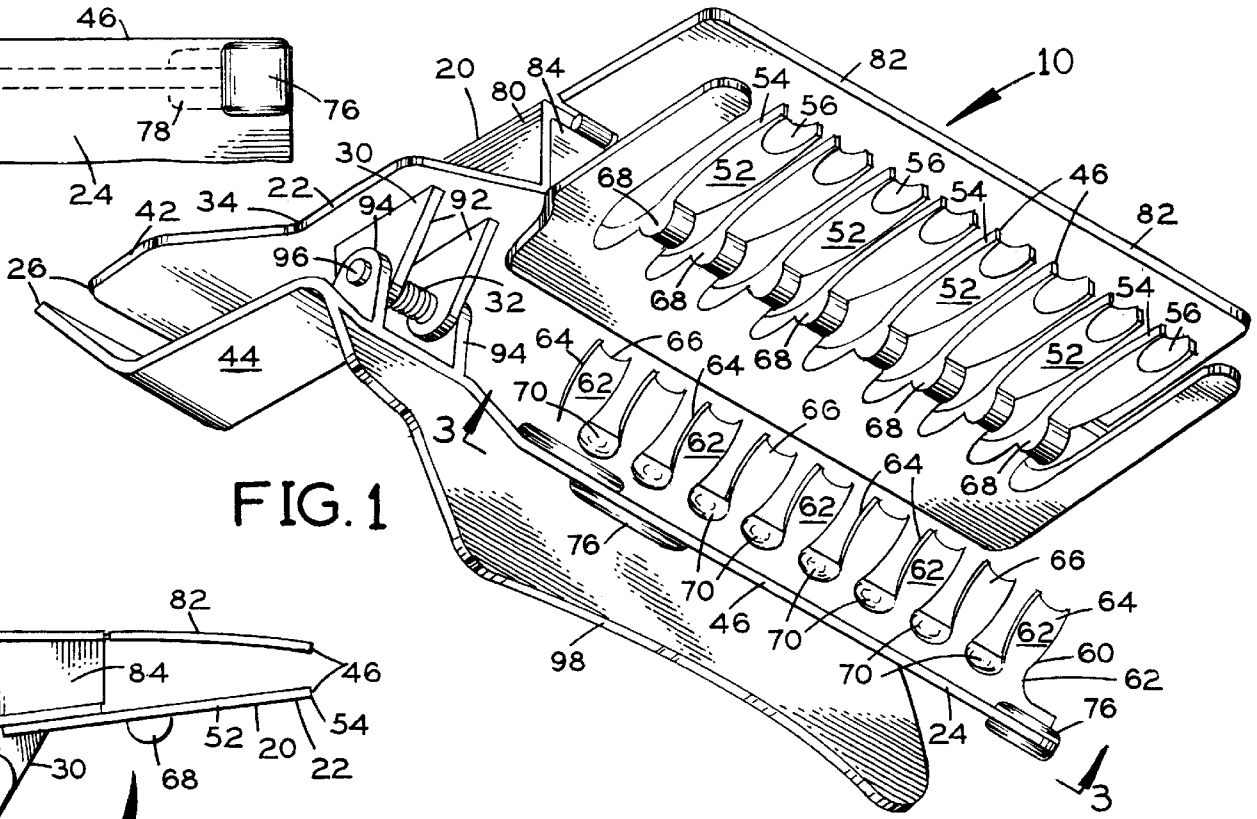
FIG. 1 is a perspective view of the inventive clip apparatus with the jaws open.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
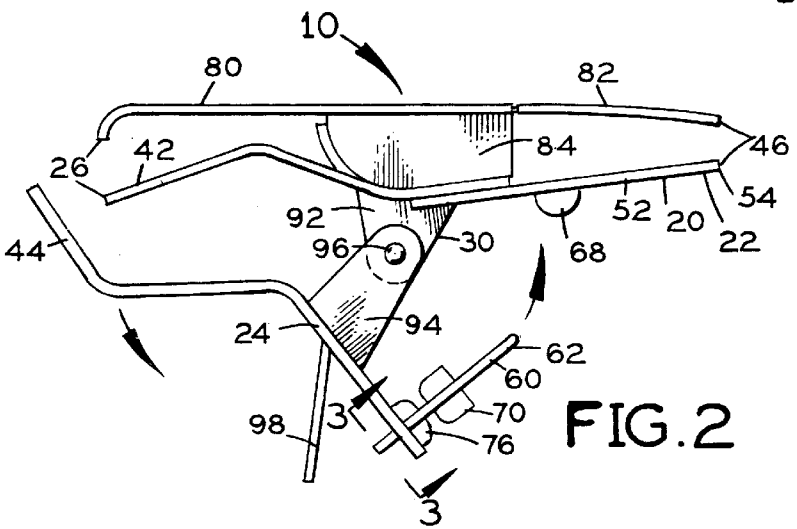
FIG. 2 is a side view of the apparatus as in FIG. 1.
Figure 3:
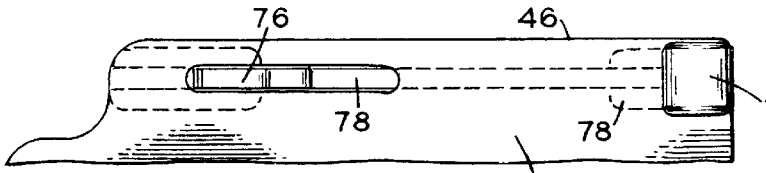
FIG. 3 is a broken-away close-up view of the comb fastening slots and hooks taken along lines 3—3 of FIGS. 1 and 2.
Figure 4:
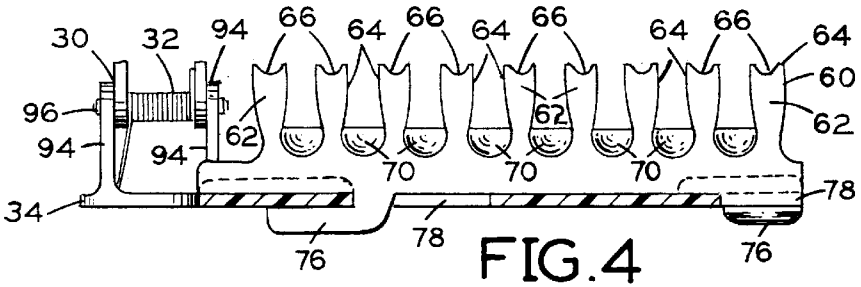
FIG. 4 is a front view of the comb with the upper jaw shown in cross-section to reveal the configurations of the comb fastening slots and hooks.
Figure 6:
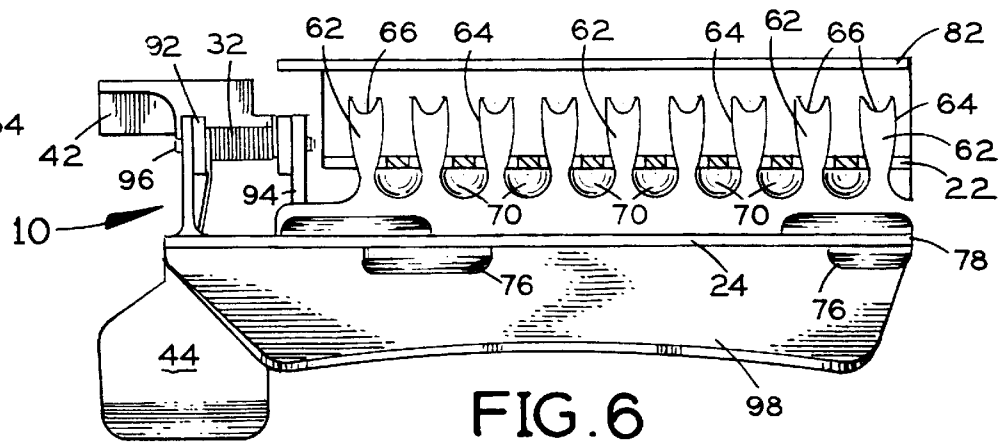
FIG. 6 is a front view of the closed clip apparatus taken along lines 6—6 of FIG. 5.
Figure 8:
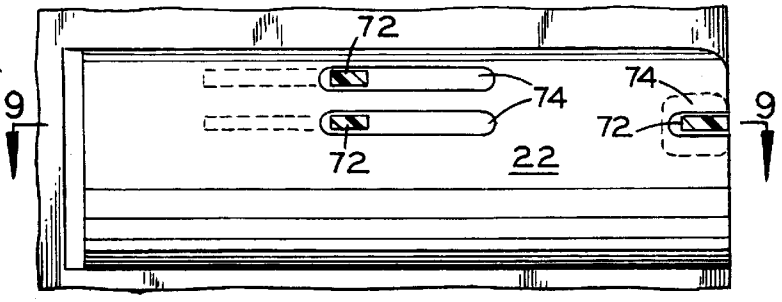
FIG. 8 is a broken away bottom view of the clip upper jaw taken along lines 8—8 of FIG. 7 and showing the panel portion fastening slots and hooks.
Figure 9:
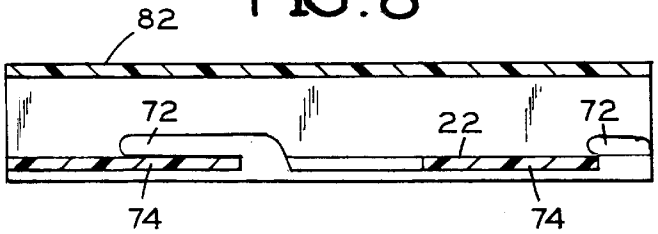
FIG. 9 is front view of the clip upper jaw and fastening slots and hooks taken along lines 9—9 of FIG. 8.
Figure 5:
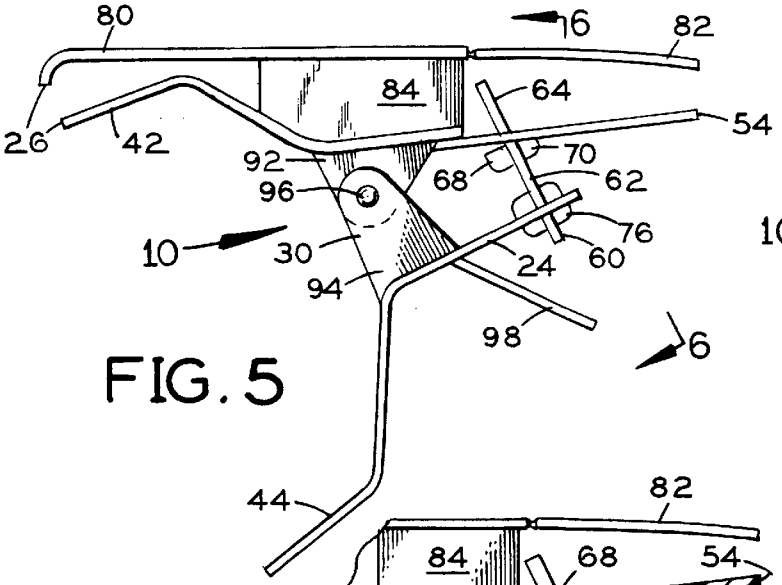
FIG. 5 is side view as in FIG. 2, but with the clip jaws shown closed.
Figure 10:
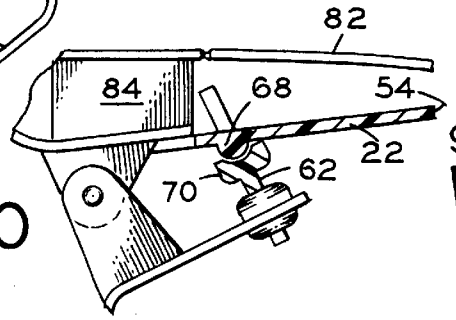
FIG. 10 is a partial cross-sectional view of the closed apparatus of FIG. 5.
Figure 7:
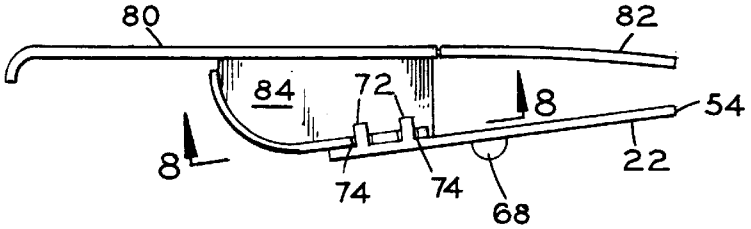
FIG. 7 is a separate side view of the clip upper jaw and the hair supporting primary platform and platform section.
Figure 11:
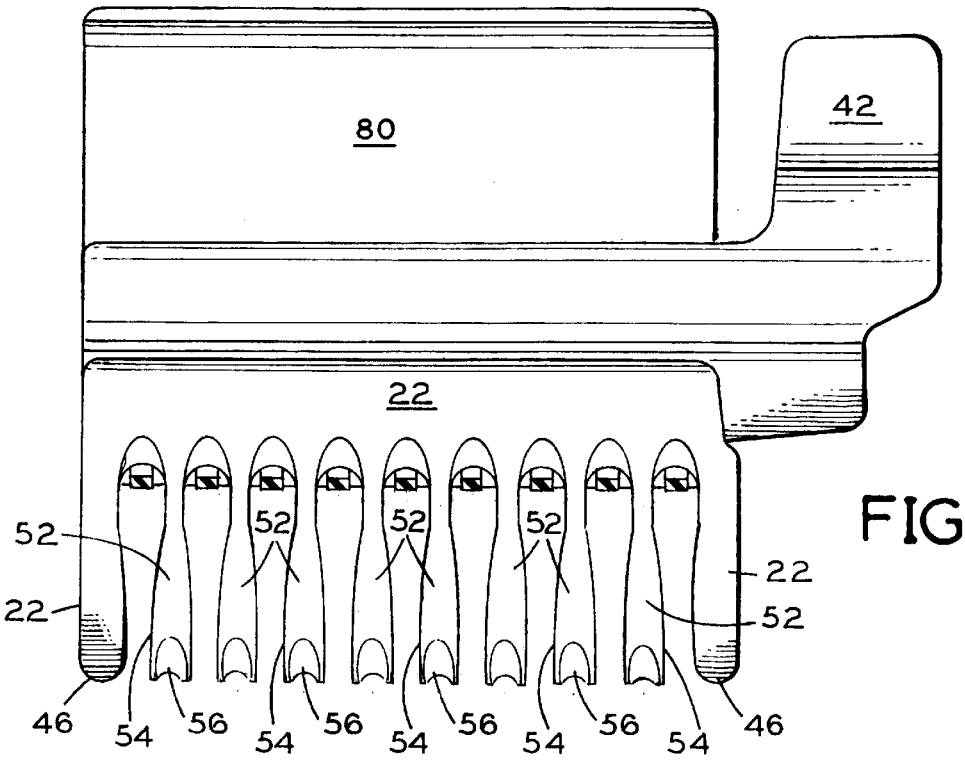
FIG. 11 is a top view of the apparatus of FIG. 1.
Figure 12:
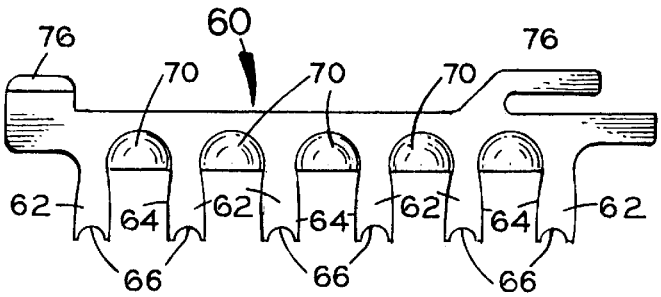
FIG. 12 is a front view of the apparatus comb.
Figure 13:
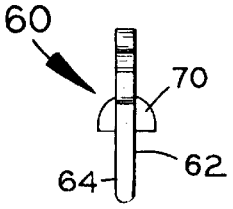
FIG. 13 is an end view of the apparatus comb of FIG. 12.
Figure 14:
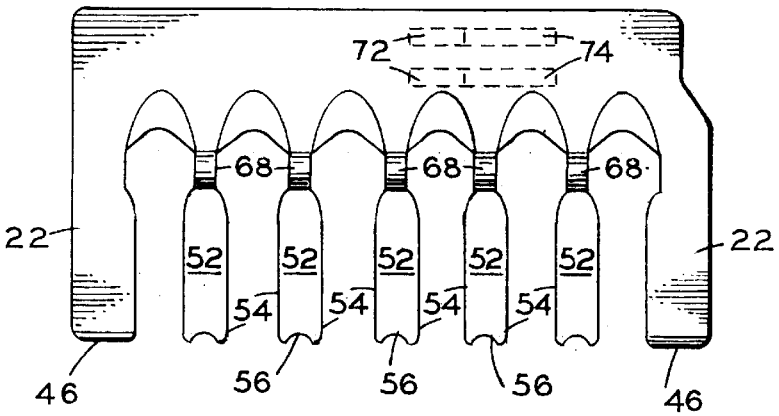
FIG. 14 is a top view of the forward upper jaw portion having the spaced apart bundle holding panels.
Figure 15:
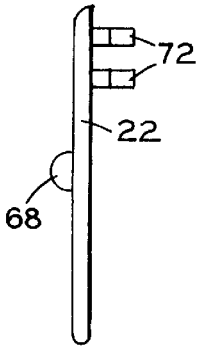
FIG. 15 is an end view of the apparatus comb of FIG. 14.

Referring to FIGS. 1–15, a clip apparatus 10 is disclosed for evenly grouping and separating a series of bundles of hair, and lifting every other hair bundle away from the scalp, so that every other bundle can be colored to produce a streaking effect. The term colored and coloring matter will be understood to be inclusive of terms bleached and bleaching matter, respectively, for purposes of this application.

Apparatus 10 includes a clip 20 having a clip upper jaw 22 and a clip lower jaw 24 interconnected along opposing jaw rearward edges 26 by a hinge structure 30, the clip upper and lower jaws 22 and 24 being biased with a hinge spring 32 to close together. Upper and lower finger tabs 42 and 44, respectively, protrude rearwardly from clip upper jaw 42 and clip lower jaw 44 rearward edges 26 at a tab side 34 of clip 20. Finger tabs 42 and 44 are configured to be spaced apart from each other when clip 20 is closed, so that the user can open jaws 22 and 24 by pressing finger tabs 42 and 44 toward each other. Upper jaw 22 has a series of notches along its forward edge 46 defining a series of laterally spaced apart hair holding panels 52 for holding alternating bundles of hair against the scalp. Panels 52 preferably have free ends 54 with concave cuts 56. Lower jaw 24 has an upwardly projecting comb 60 with broad teeth 62 spaced apart from each other and positioned such that one comb tooth 62 swings between each adjacent pair of holding panels 52 when clip 20 is closed. Each comb tooth free end 64 has an upwardly opening recess 66 to engage and move a bundle of hair between adjacent holding panels 52 and above upper jaw 22. Between each pair of comb teeth 62 is preferably provided a cup structure 70 which receives a hair holding knob 68 protruding downwardly from the lower face of a corresponding holding panel 52. Cup structures 70 and holding knobs 68 grip the alternating hair bundles not elevated by comb 60 and thereby hold apparatus 10 on the scalp during use.

The forward portion of upper jaw 22 which includes panels 52 is preferably releasibly connected to the remainder of jaw 22 with panel fasteners in the form of panel portion hooks 72 and panel portion slots 74. Similarly, comb 60 is preferably separate from and removably connected to the remainder of lower jaw 24 with fasteners in the form of comb hooks 76 and comb slots 78. This construction permits replacement of panels 52 and of comb teeth 62 with wider or narrower panels 52 and teeth 62 for altering the width of hair streaks produced with apparatus 10.

Apparatus 10 preferably additionally includes a primary platform 80 secured onto the upper surface of clip upper jaw 22 with interconnection webs 84, and a platform section 82 hingedly connected to the forward edge of primary platform 80, for supporting elevated, alternating bundles of hair to be colored.

The hinge structure includes two laterally spaced apart and upwardly extending lower jaw hinge flanges 92 and two downwardly extending upper jaw hinge flanges 94 laterally spaced to simultaneously fit between lower jaw hinge flanges 92. Upper and lower jaw hinge flanges 94 and 92, respectively, each include a laterally directed hinge port through which a hinge pin 96 fits. Hinge spring 32 is preferably a coil spring encircling hinge pin 96 and having spring ends extending to bear against clip upper and lower jaws 22 and 24.

A clip propping flange 98 preferably angles downwardly and forwardly from clip lower jaw 24 to orient clip 20 on the scalp so that lower jaw 24 remains substantially horizontal during clip 20 operation. Apparatus 10 is preferably made of a suitable plastic, although fabrication from metals and other materials is contemplated.

Method

In practicing the invention, the following method may be used. The hair dresser separates and lifts away from the scalp a top layer of hair rooted adjacent the middle of the scalp, opens clip 20 and laterally slides the layer of hair into the receiving side of clip 20. Then the hair dresser closes clip 20, and as it closes, recesses 66 at each comb tooth free end 64 move alternating bundles of hair between holding panels 52. At the same time, each holding panel 52 holds down an adjacent and similarly sized bundle of hair. As a result, in closing clip 20, one bundle of hair is elevated by a comb tooth 62, the next bundle of hair is held against the head by an adjacent holding panel 52, and the next bundle of hair is elevated by the next comb tooth 62, and so on along the entire clip 20 forward edge 46. After closing clip 20, the hair dresser pulls the free ends of the elevated bundles of hair upwardly and out from underneath clip upper jaw 22, one by one, and lays each onto primary platform 80. The elevated hair bundles remain separated as they rest on platform 80. Then the hair dresser pivots hinged platform section 82 to its contiguous position with primary platform 80, thus extending the support surface for the elevated, alternating hair bundles. The hair dresser places a sheet of aluminum foil (not shown) between the elevated bundles of hair and the composite upper surface of primary platform 80 and platform section 82. This prevents coloring matter from reaching clip 20 and the remaining hair. Hair coloring matter is then applied to the elevated alternating bundles of hair and permitted to remain until the coloring matter takes effect. Then the hair dresser opens clip 20 and slides the layer of hair out of apparatus 10, lifts a new top layer of hair to be streaked, inserts the new top layer into clip 20 and repeats the above-recited steps. It is noted, as an alternative to this method, that the hair dresser may place only some of the elevated hair bundles onto platform 80 for creating more widely spaced apart or differently patterned streaking.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of coloring alternating bundles of hair using an apparatus comprising a clip including a clip upper jaw having a forward jaw edge and a rearward jaw edge having a series of notches along said forward jaw edge defining a series of laterally spaced apart hair holding panels for holding bundles of hair against the user scalp and a clip lower jaw having a forward jaw edge and a rearward jaw edge having an upwardly projecting comb with teeth spaced apart from each other and positioned such that one comb tooth swings between each adjacent pair of holding panels when said clip is closed; and a hinge structure interconnecting said clip upper jaw and said clip lower jaw along said rearward jaw edges, comprising the steps of:

lifting away from the scalp a top layer of hair;

pivoting said clip upper jaw relative to said clip lower jaw to open said clip;

sliding the layer of hair laterally into said clip between said clip upper jaw and said clip lower jaw;

pivoting said clip upper jaw relative to said clip lower jaw to close said clip, such that said comb teeth free ends engage and move bundles of hair from the layer between said holding panels, thereby elevating alternating bundles of hair, and such that each holding panel holds adjacent bundles of hair against the scalp;

pulling the free ends of the elevated bundles of hair out from underneath said clip upper jaw and laying said elevated bundles of hair over said clip upper jaw;

applying hair coloring matter to the elevated bundles of hair and permitting the coloring matter to color the elevated bundles;

pivoting said clip upper jaw relative to said clip lower jaw to open said clip;

and sliding the layer of hair out of said clip.

2. A method according to claim 1, wherein said clip apparatus further comprises a platform secured onto the upper surface of said clip upper jaw, comprising the additional step of:

placing the elevated bundles of hair onto said platform.

3. A method according to claim 1, comprising the additional step of:

placing a sheet of aluminum foil between the elevated bundles of hair and said clip upper jaw.

PARTS LIST

| | |
|---|---|
| 10. Apparatus | 80. Primary platform |
| 20. Clip | 82. Platform section |
| 22. Upper jaw | 84. Interc. webs of primary platform |
| 24. Lower jaw | 92. Upper jaw hinge flanges |
| 26. Jaw rearward edges | 94. Lower jaw hinge flanges |

-continued

PARTS LIST

30. Hinge structure
32. Hinge spring
34. Tab side of clip
42. Upper finger tab
44. Lower finger tab
46. Jaw forward edges
52. Hair holding panels
54. Panel free ends
56. Concave cuts in free ends 54
60. Comb
62. Broad teeth
64. Tooth free ends
96. Hinge pin
98. Clip propping flange -continued

PARTS LIST

66. Recess in comb free ends
68. Holding knobs
70. Cup structures for receiving knobs 68
72. Upper jaw hooks
74. Upper jaw slots
76. Comb hooks
78. Lower jaw slots

* * * * *